US006705881B2

(12) United States Patent
Tsuchiya

(10) Patent No.: US 6,705,881 B2
(45) Date of Patent: Mar. 16, 2004

(54) LEVER-TYPE CONNECTOR

(75) Inventor: Takashi Tsuchiya, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/147,609

(22) Filed: May 15, 2002

(65) Prior Publication Data

US 2002/0173186 A1 Nov. 21, 2002

(30) Foreign Application Priority Data

May 18, 2001 (JP) ..... 2001-148868

(51) Int. Cl.[7] ..... H01R 13/62
(52) U.S. Cl. ..... 439/157; 439/489; 439/950
(58) Field of Search ..... 439/157, 372, 439/188, 488, 489, 490, 950

(56) References Cited

U.S. PATENT DOCUMENTS 5,135,410 A 8/1992 Kawase et al.

*Primary Examiner*—Khiem Nguyen
(74) *Attorney, Agent, or Firm*—Anthony J. Casella; Gerald E. Hespos

(57) ABSTRACT

A lever-type connector electrically detects a connected state of housings and has an improved reliability in its connection detecting function. A magnet (33) is provided integrally in an operable portion (31) of a lever (30), and a lead switch (50) is provided at the bottom surface of a receptacle (41). The lever (30) is operated to engage cam pins (44) with cam grooves (35), and female and male housings (10, 40) are properly connected by the cam action and the lead switch (50) is turned on by a magnetic force of the magnet (33). Whether the two housings (10, 40) are connected properly can be detected electrically by connecting the lead switch (50) with a detecting circuit or the like.

7 Claims, 6 Drawing Sheets

LEVER-TYPE CONNECTOR

BACKGROUND OF THE INVENTION

1. Field of the Invention

The invention relates to a lever-type connector with a connection detecting function.

2. Description of the Related Art

A lever-type connector comprises first and second housings that are connectable with one another. A lever is mounted pivotally on the first housing and a cam pin projects from the second housing. The cam pin is inserted into a cam groove formed in the lever during the connection of the housings. The lever then is pivoted to a specified connection position, and the cam action of the cam groove and the cam pin pull the housings into connection.

An operator normally judges the proper connection of the two housings in the above-described lever-type connector by a locking sound and a locking feeling given when the lever is locked at the connection position. However, the locking sound and the locking feeling may not be given if the locking mechanism does not have a precise shape. Hence there is a possibility that the operator may make a wrong judgment.

A lever-type connector designed to detect a connected state of housings electrically is shown in U.S. Pat. No. 5,135,410. This connector has a lever with electrically conductive contacts, and the mating housing has two detection terminals connected with a detection circuit. The detection terminals are brought into contact with contacts of the lever when the lever reaches a connection position during the connection of the two housings. Thus, the detection terminals are shorted to detect the properly connected state of the housings.

However, the contacts of the lever and the detection terminals are on the outer surfaces of the housings and they may be deformed by contact with external matter, for example, during transportation before the housings are connected. Thus, the connection detection function of this connector has lacked reliability. Further, it is very difficult to achieve waterproofing because the detection terminals are on the outer surface of the housings.

In view of the above, an object of the invention is to provide a lever-type connector that can detect a connected state of housings electrically, and that has an improved connection detecting reliability.

SUMMARY OF THE INVENTION

The invention is directed to a lever-type connector with at least first and second housings that are connectable with each other. A lever is displaceably mounted on the first housing. The lever and the second housing are provided with a cam mechanism that comprises a cam groove and a cam pin engageable with the cam groove. The cam pin is insertable into the cam groove when the lever is at a standby position. The lever then can be operated so that the cam action of the cam mechanism pulls the housings toward each other and into a connected condition.

An electric or electronic non-contact detector is provided for detecting when the lever is in the connection position, and hence for detecting whether the housings are connected properly. The electric non-contact detector is turned on or detects the lever in the connection position without contacting the lever. Thus, detection terminals and contacts need not be provided on the outer surface of the housings, and, unlike the prior art, deformation, oxidation and the like can be reduced. As a result, the reliability of the connection detecting function can be improved.

The electric non-contact detector preferably comprises an electromagnetic device integrally in the lever and a lead switch in one of the housings. The electromagnetic device turns on the lead switch as the lever is displaced to the connection position. The lead-switch preferably comprises contacts hermetically sealed in a housing and is connected with a detecting circuit or the like. Thus, a properly connected state of the housings can be detected electrically. The lead switch is turned on without contacting the lever and there are no detection terminals and contacts on the outer surfaces of the housings. Accordingly, no parts of the detector are subject to deformation or oxidation and connection detection is more reliable than in the prior art.

A watertight area may be formed between the connected housings. The lead switch operates without contacting the lever, and hence can be sealed in the watertight area.

The electric non-contact detector preferably is connectable to a detection circuit by terminal fittings in at least one of the housings.

At least part of the electric non-contact detector preferably is provided in at least one of the housings by integral molding.

The lever preferably abuts at least one stopper at connection position. Additionally, locking means may lock the lever at the standby position and/or the connection position.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
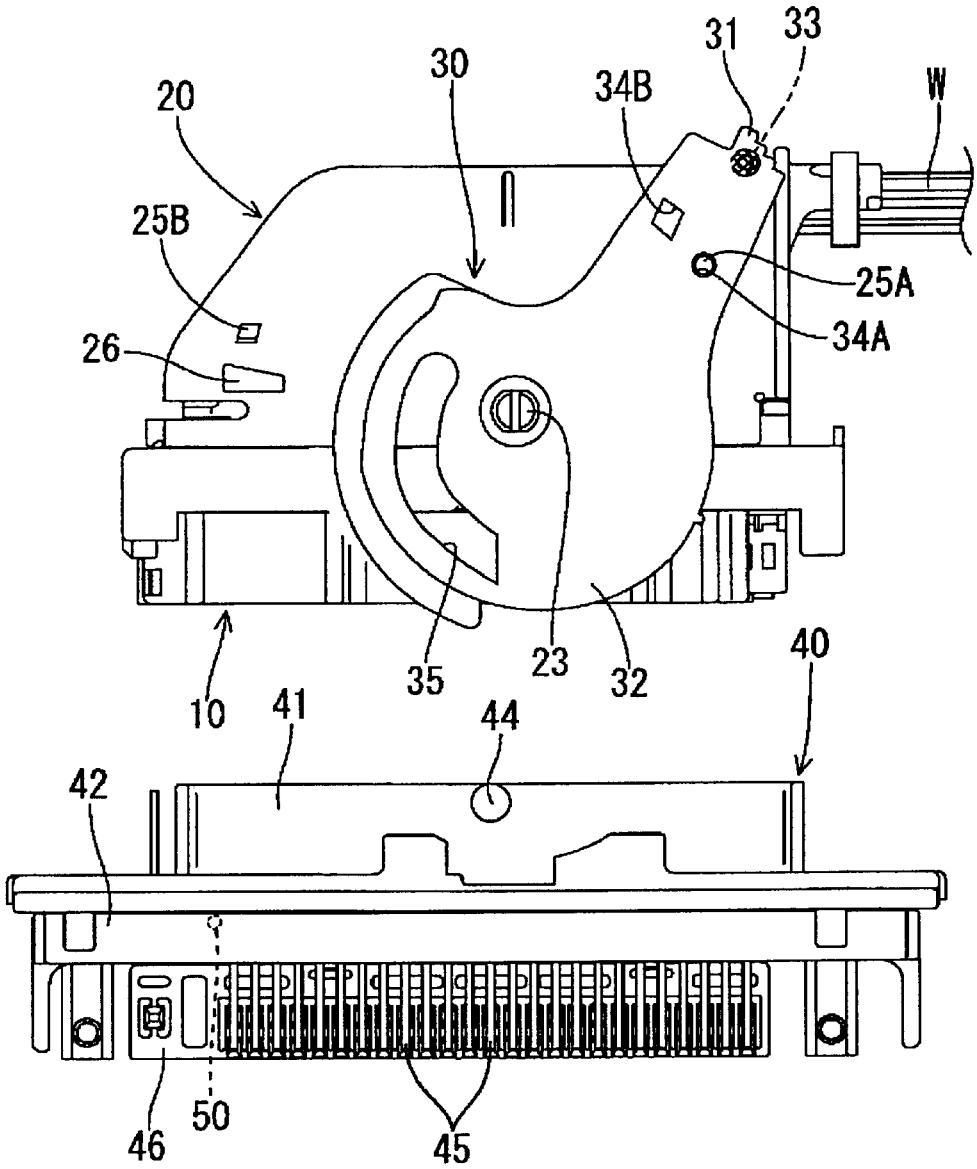
FIG. 1 is a side view showing a state of a female housing and a male housing according to one embodiment of the invention before connection.

A lever-type connector according to the invention includes a female housing 10 and a male housing 40 connectable with and separable from each other. A wire cover 20 is mounted on the female housing 10 for substantially covering at least portions of wires W, and a lever 30 is mounted on the wire cover 20 for assisting the connection of the female and male housings 10, 40. In the following description, reference is made to FIG. 1 concerning the vertical direction, and the left side in FIG. 1 is referred to as the front side.

The female housing 10 is made e.g. of a synthetic resin and defines a substantially rectangular parallelepipedic shape. Vertically extending cavities 11 are formed in two transversely extending rows, and female terminal fittings 12 are inserted into the cavities 11 preferably from behind when seen in a connecting direction with the male connector housing 40. One end of each female terminal fitting 12 is crimped into connection with an end of the wire W and a rubber plug 13. Each wire W is drawn out above the female housing 10 from the corresponding cavity 11. A clearance at an upper part of each cavity 11 between the inner surface of the cavity 11 and the outer surface of the wire W is sealed hermetically by the rubber plug 13. An annular sealing member 14 is mounted on the outer surface of a base end portion of the female housing.

Figure 2:
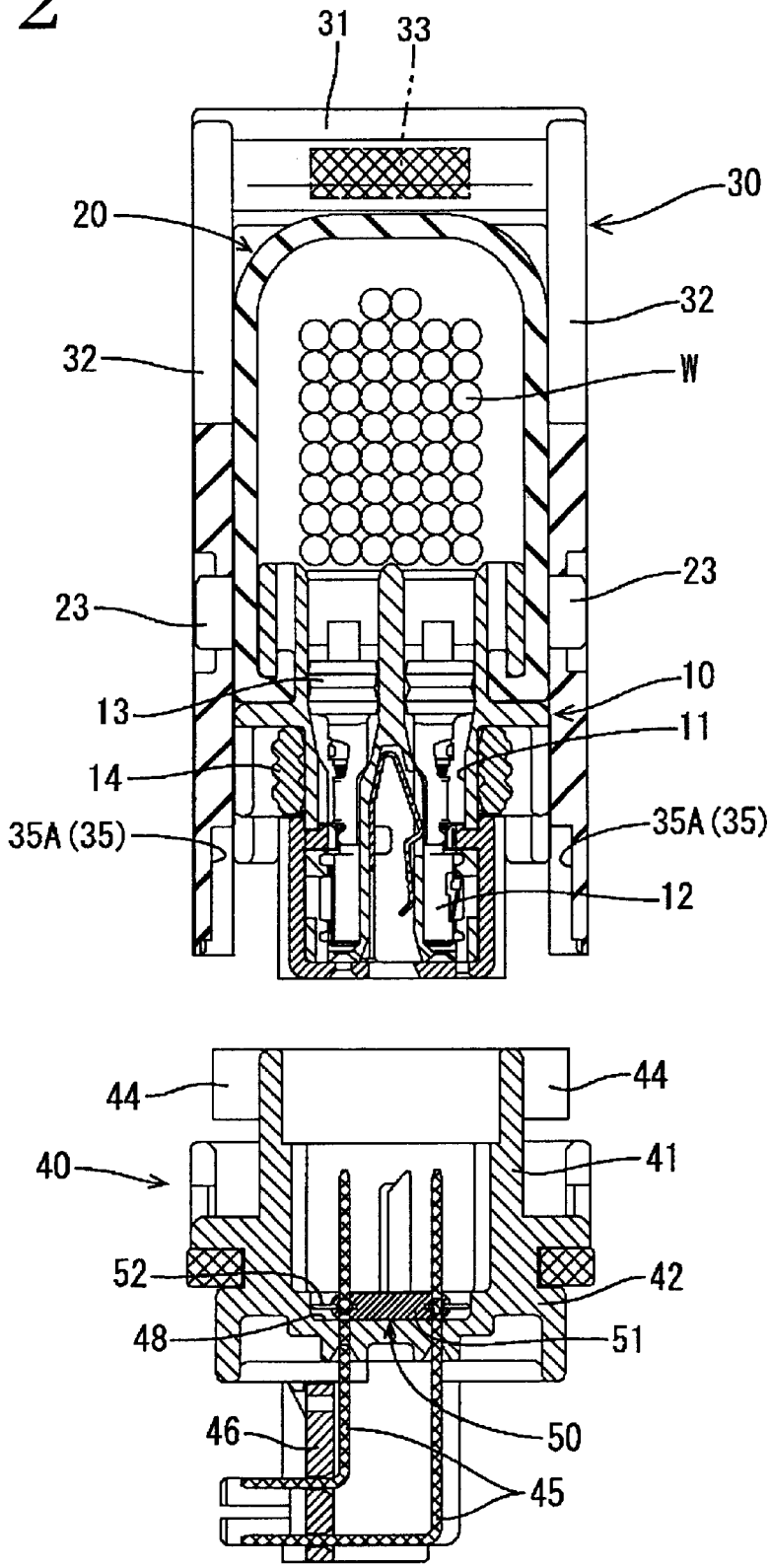
FIG. 2 is a front view in section showing the state of the female and male housings before connection.
Figure 3:
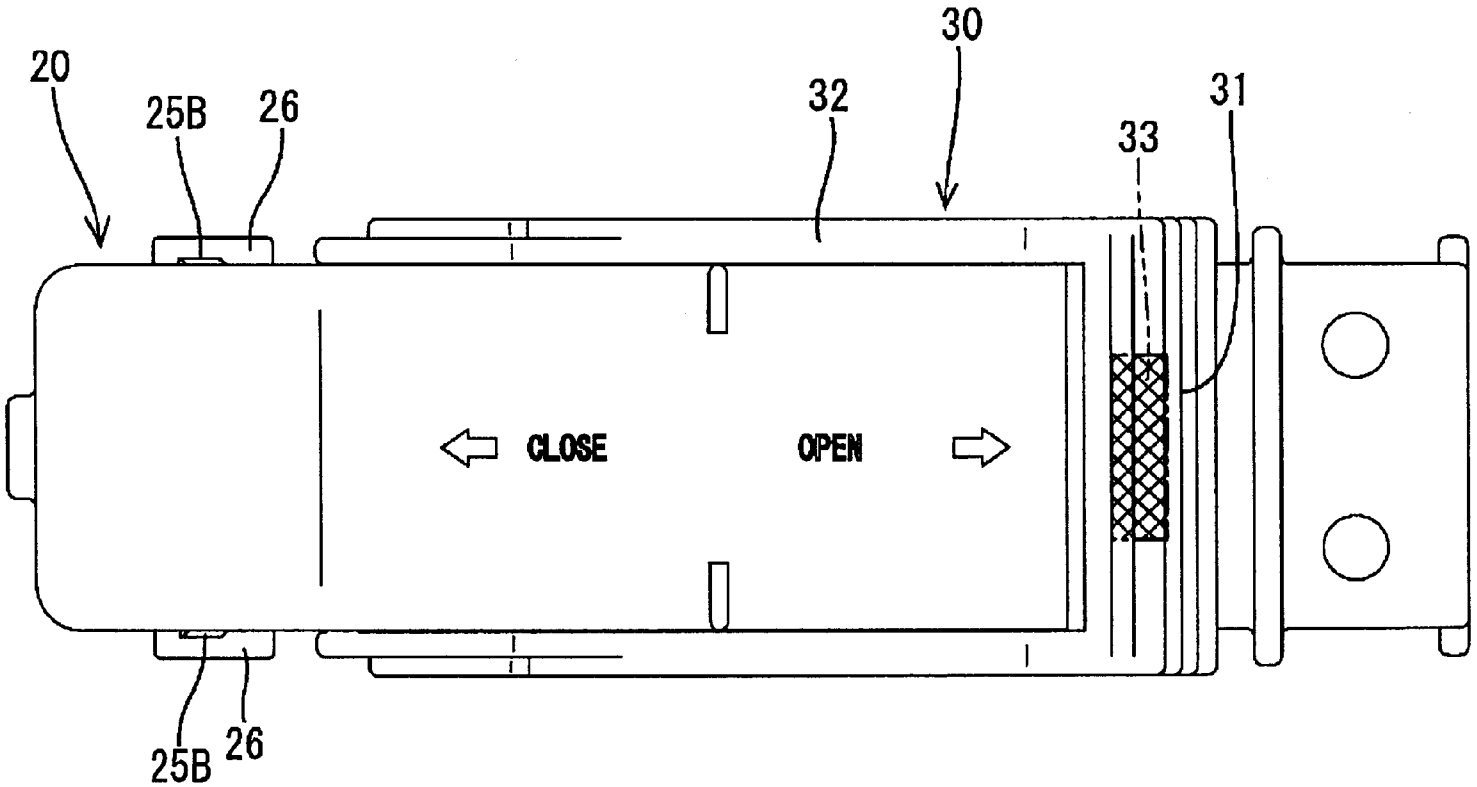
FIG. 3 is a plan view of the female connector housing.

The wire cover 20 is made e.g. of a synthetic resin and is substantially in the form of a box that opens down and back, as shown in FIGS. 1 to 3. The bottom opening of the wire cover 20 is mounted to an upper part of the female housing 10. The wires W from the cavities 11 are bent at substantially right angles inside the wire cover 20 and are drawn out through the rear opening of the wire cover 20. Left and right lateral supporting shafts 23 project from the opposite side surfaces of the wire cover 20, and the lever 30 is mounted on the supporting shafts 23 to substantially surround the wire cover 20.

The lever 30 is made e.g. of a synthetic resin, and is substantially U-shaped. More particularly, the lever 30 includes a transversely extending operable portion 31 and plate-shaped arms 32 that extend from opposite ends of the operable portion 31. A bar-shaped permanent magnet 33 is embedded in the operable portion 31 by integral molding and has N- and S-poles at opposite transverse ends or exit the lever 30 at the plate-shaped arms 32.

Base ends of the arms 32 are widened for mounting on the supporting shafts 23, so that the lever 30 is pivotal about the shafts 23 between a standby position and a connection position. At the standby position shown in FIGS. 1 and 2, the operable portion 31 contacts the upper surface of the wire cover 20 to restrict any further clockwise rotation of the lever 30, and the lever 30 is held by engagement of substantially round first projections 25A on opposite sides of the wire cover 20 with first locking holes 34A in the arms 32. Cam grooves 35 are formed at base ends of the arms 32, and entrances 35A of the cam grooves 35 face down toward the male housing 40 at the standby position.

Figure 5:
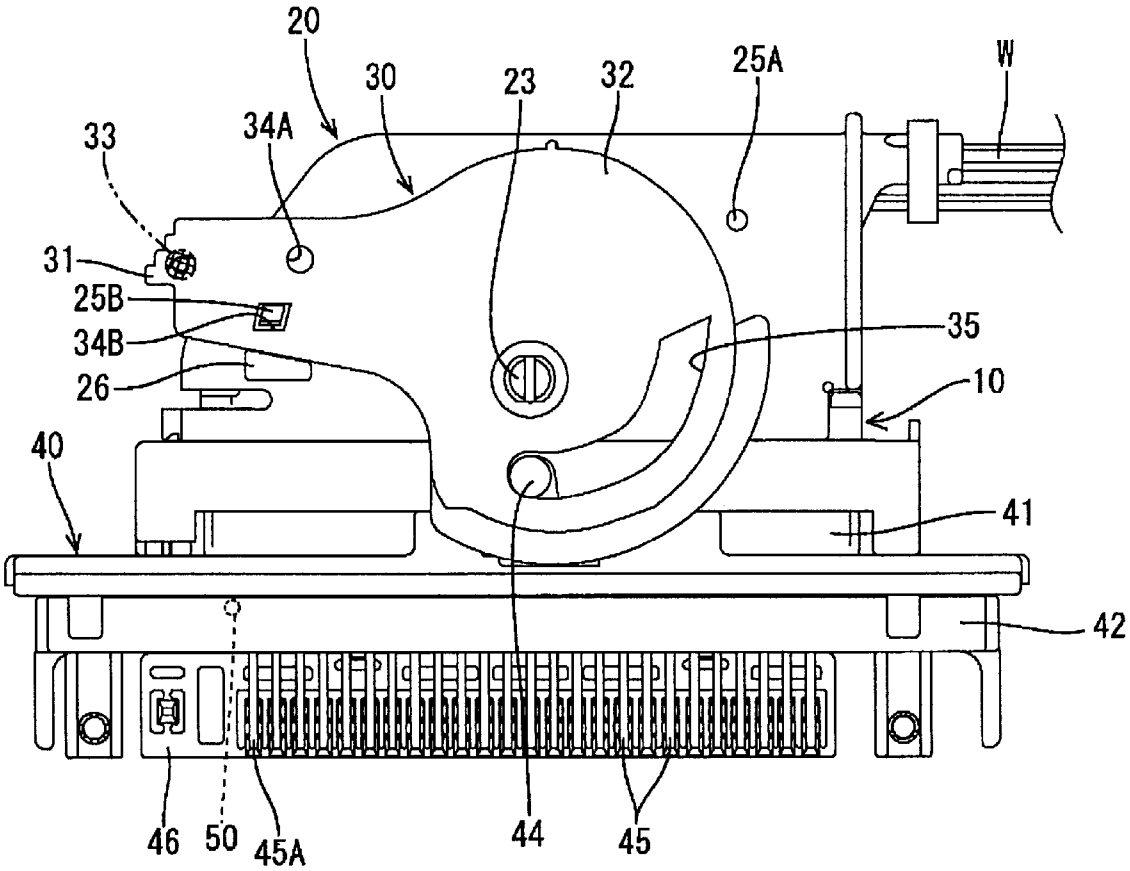
FIG. 5 is a side view showing a state of the female and male housings after completion of connection.
Figure 6:
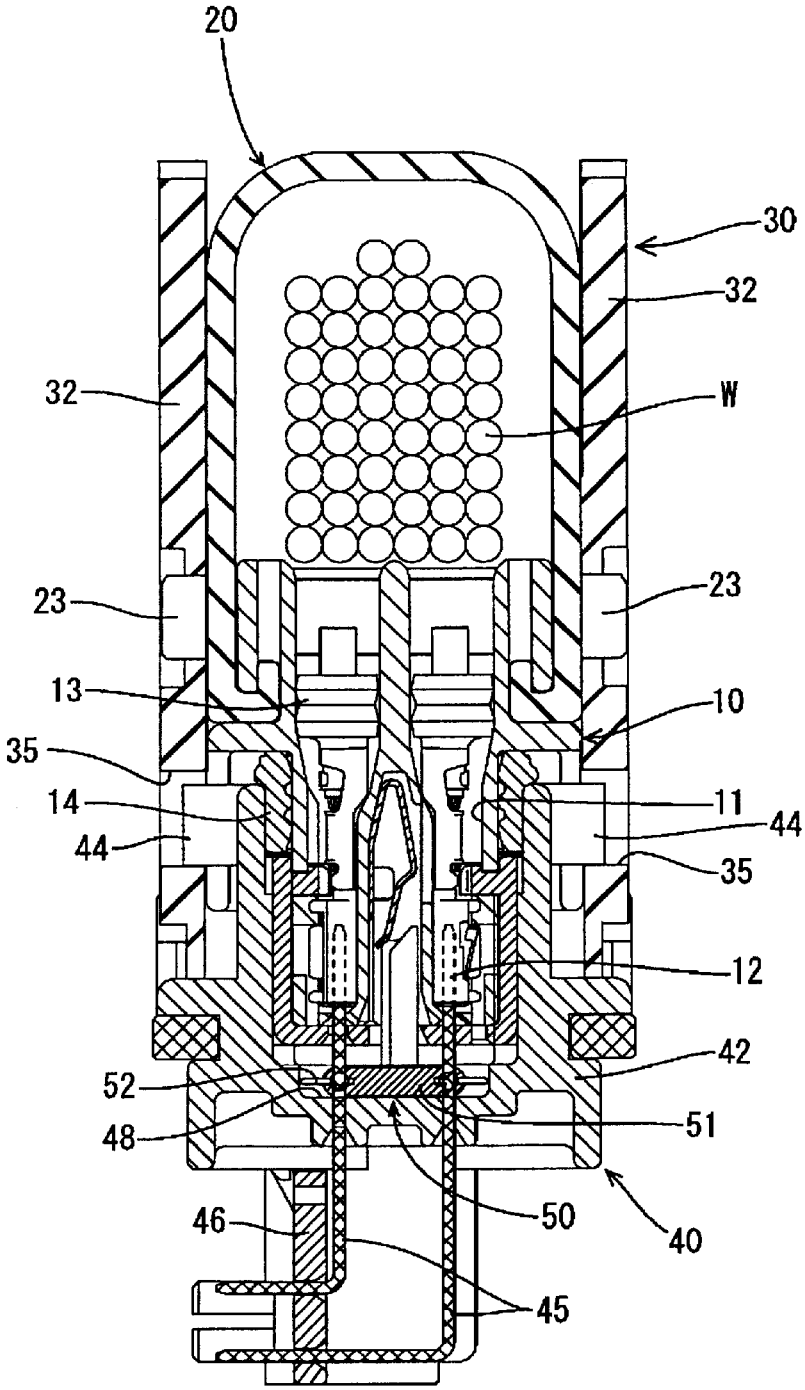
FIG. 6 is a front view in section showing the state of the female and male housings after completion of connection.

Leading ends of the arms 32 contact stoppers 26 that project from the opposite side surfaces of the wire cover 20 at the connection position shown in FIGS. 5 and 6. The stoppers 26 restrict any further counterclockwise rotation of the lever 30 in FIG. 5. Thus, the lever 30 is held by the engagement of substantially rectangular second projections 25B that project immediately above the stoppers 26 and second locking holes 34B of the arms 32.

Figure 4:
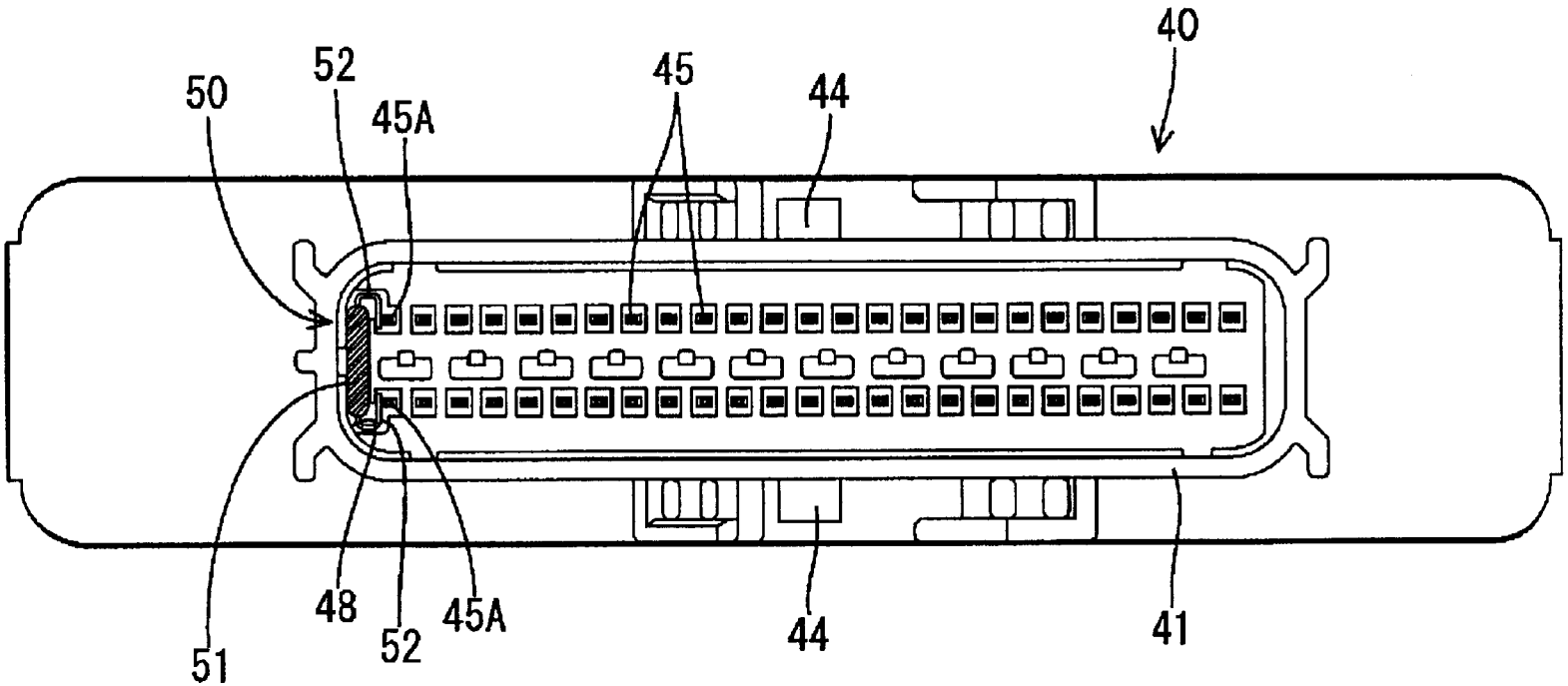
FIG. 4 is a plan view of the male connector housing.

The male housing 40 is mountable on an unillustrated circuit board, and has a substantially rectangular tubular receptacle 41 that opens up toward the female housing 10. A mounting wall 42 substantially closes the bottom end of the receptacle 41, as shown in FIGS. 1, 2 and 4. The bottom part of the female housing 10 is fittable into the receptacle 41 so that the sealing member 14 is held in close contact with the outer surface of the female housing 10 and the inner surface of the receptacle 41. Thus, watertight spaces are defined inside the receptacle 41 and inside the cavities 11 before the rubber plugs 13 and are sealed from the outside. Cam pins 44 project from the left and right lateral outer surfaces of the receptacle 41. Long narrow substantially L-shaped male terminal fittings 45 penetrate the mounting wall 42 in two rows, such that one end of each terminal fitting 45 projects into the receptacle 41 for connection with the corresponding female terminal fitting 12 when the female and male housings 10, 40 are connected. The other ends of the male terminal fittings 45 penetrate through an alignment plate 46 on the male housing 40.

A narrow lead switch chamber 48 extends transversely at the bottom surface of the receptacle 41 and is formed at one end (front end) with respect to longitudinal direction. The lead switch 50 for detecting the connection is accommodated in the switch chamber 48, as shown in FIG. 4. The lead switch 50 is such that contacts are sealed hermetically with an insert gas (e.g. He, Ar or the like) in a narrow transversely extending glass tube 51, and electrodes 52 project from the opposite ends of the glass tube 51. Each electrode 52 is soldered to the closest one 45A of the male terminal fittings 45 of the corresponding row. During connection of the female and male housings 10, 40, the magnet 33 approaches the lead switch 50 as the lever 30 is pivoted from the standby position to the connection position. The lead switch 50 is turned on by a magnetic force of the magnet 33 when the lever 30 is at the connection position and when the magnet 33 is closest to the lead switch 50. Conversely, the lead switch 50 is turned off when the lever 30 leaves the connection position and moves toward the standby position because the magnetic force of the magnet 33 is not sufficient to keep the lead switch 50 on.

The female and male housings 10, 40 are connected by first pivoting the lever 30 to the standby position (see FIGS. 1 and 2). This brings the entrances 35A of the cam grooves 35 to positions where they can oppose the cam pins 44. In this state, the housings 10, 40 are brought closer to and lightly connected with each other so that the cam pins 44 enter the entrances 35A of the cam grooves 35. The lever 30 then is pivoted toward the connection position, and the housings 10, 40 are pulled together by the cam action of the cam grooves 35 and the cam pins 44. The female and male housings 10, 40 are connected properly with each other when the lever 30 reaches the connection position, and the lead switch 50 is turned on by the magnetic force of the magnet 33. The properly connected state of the housings 10, 40 can be detected by the external detecting circuit connected with the lead switch 50.

The lead switch 50 is turned on without contacting the lever 30. Thus, unlike the prior art, the detection terminals and the contacts need not be provided on the outer surfaces of the housings. Further, the contacts are in the glass tube 51 and are not subject to deformation, oxidation and the like. As a result, the reliability of the connection detecting function can be improved.

Further, the lead switch 50 operates without contacting the lever 30, and can be sealed securely in the watertight area inside the receptacle 41.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The lead switch 50 is in the housing that mates with the housing on which the lever 30 is mounted in the foregoing embodiment. However, the lead switch may be in the housing on which the lever is mounted.

The lever-type connector is a watertight connector with watertight areas in the foregoing embodiment. However, the invention is also applicable to connectors other than watertight connectors.

Even though the invention has been described with reference to a lead switch and a magnet, any other electrical/electronic proximity switch of the non-contact type, such as a transducer, may be used.

Even though the invention has been described with a reference to a lever pivotally provided on one of the connector housings, the lever may be movable along a linear or other non-linear path, such as a slider.

What is claimed is:

1. A lever-type connector, comprising:

at least first and second housings that are connectable with each other;

a lever displaceably mounted on the first housing, the lever and the second housing being provided with a cam mechanism comprising a cam groove and a cam pin engageable with the cam groove, the cam pin being insertable into the cam groove with the lever held at a standby position, and the housings being pulled toward one another and connected by a cam action of the cam mechanism by operating the lever to a connection position; and an electric non-contact detector being provided for detecting when the lever is in the connection position, the electric non-contact detector comprising an electromagnetic device integrally provided in a selected one the lever and the housings and a switch which is turned on by the electromagnetic device as the lever is displaced from the standby position to the connection position.

2. The lever-type connector of claim 1, wherein the switch comprises contacts hermetically sealed in a housing.

3. The lever-type connector of claim 1, comprising a watertight area sealed from outside when the housings are connected, the switch being provided in the watertight area.

4. The lever-type connector of claim 1, wherein the electric non-contact detector is connectable to a detection circuit via terminal fittings provided in at least one of the connector housings.

5. The lever-type connector of claim 1, wherein at least part of the electric non-contact detector is provided in at least one of the connector housings by integral molding.

6. The lever-type connector of claim 1, wherein the lever abuts at least one stopper when reaching the connection position.

7. The lever-type connector of claim 1, wherein the lever is locked at the standby position and the connection position by means of locking means.

* * * * *